US005922923A

United States Patent [19]

Park et al.

[11] Patent Number: 5,922,923

[45] Date of Patent: Jul. 13, 1999

[54] ZEOLITIC REFORMING WITH SELECTIVE FEED-SPECIES ADJUSTMENT

[75] Inventors: John Y. G. Park, Naperville; Santi Kulprathipanja, Inverness; Robert S. Haizmann, Rolling Meadows, all of Ill.

[73] Assignee: UOP LLC, Des Plaines, Ill.

[21] Appl. No.: 08/723,208

[22] Filed: Sep. 27, 1996

[51] Int. Cl.[6] ..... C07C 15/00; C07C 2/52; C10G 35/04

[52] U.S. Cl. ..... 585/413; 585/407; 585/419; 208/134

[58] Field of Search ..... 585/407, 413, 585/419, 322, 421, 826, 827, 828; 208/134

[56] References Cited

U.S. PATENT DOCUMENTS

| | | | |
|---|---|---|---|
| 2,985,589 | 5/1961 | Broughton et al. | 210/34 |
| 4,053,388 | 10/1977 | Bailey | 585/322 |
| 4,347,123 | 8/1982 | Mauldin et al. | 585/421 |
| 4,435,283 | 3/1984 | Buss et al. | 208/138 |
| 4,567,315 | 1/1986 | Owaysi et al. | 585/827 |
| 4,664,777 | 5/1987 | Hudson et al. | 208/112 |
| 4,804,457 | 2/1989 | Ngan | 208/64 |
| 4,962,250 | 10/1990 | Dessau et al. | 585/419 |
| 5,300,715 | 4/1994 | Vora | 585/820 |

*Primary Examiner*—Glenn Caldarola
*Assistant Examiner*—Thuan D. Dang
*Attorney, Agent, or Firm*—Thomas K. McBride; John F. Spears, Jr.; Richard E. Conser

[57] ABSTRACT

The feedstock to an aromatization process is processed by a selective adsorption step to remove hydrocarbon species, particularly indan, which have a severe adverse effect on aromatization catalyst stability. The feedstock preferably is a paraffinic raffinate from aromatics extraction. The intermediate from the adsorption step is particularly suitable for the selective conversion of paraffins to aromatics using a high-activity dehydrocyclization catalyst with high aromatics yields and long catalyst life.

12 Claims, 3 Drawing Sheets

ZEOLITIC REFORMING WITH SELECTIVE FEED-SPECIES ADJUSTMENT

BACKGROUND OF THE INVENTION

1. Field of the Invention

This invention relates to an improved process for the conversion of hydrocarbons, and more specifically for the catalytic reforming of gasoline-range hydrocarbons.

2. General Background

The catalytic reforming of hydrocarbon feedstocks in the gasoline range is an important commercial process, practiced in nearly every significant petroleum refinery in the world to produce aromatic intermediates for the petrochemical industry or gasoline components with high resistance to engine knock. Steps to reduce automotive pollutants while maintaining performance and gasoline quality, increasing the required knock resistance of gasoline components as measured by gasoline "octane" number, have been a major factor in the growth of catalytic-reforming capacity and continue this trend in many areas of the world. The market for petrochemicals derived from gasoline-range aromatics continues to grow substantially, creating a need for incremental reforming capacity, severity and/or efficiency. Many producers of aromatics are looking for ways to use or upgrade existing reforming capacity through more effective reforming processes and catalysts in order to meet this incremental need without building expensive new catalytic-reforming process units.

Catalytic reforming generally is applied to a feedstock rich in paraffinic and naphthenic hydrocarbons and is effected through diverse reactions: dehydrogenation of naphthenes to aromatics, dehydrocyclization of paraffins, isomerization of paraffins and naphthenes, dealkylation of alkylaromatics, hydrocracking of paraffins to light hydrocarbons, and formation of coke which is deposited on the catalyst. Increased aromatics and gasoline-octane needs have turned attention to the paraffin-dehydrocyclization reaction, which is less favored thermodynamically and kinetically in conventional reforming than other aromatization reactions. Considerable leverage exists for increasing desired product yields from catalytic reforming by promoting the dehydrocyclization reaction over the competing hydrocracking reaction while minimizing the formation of coke. In this manner, low-value paraffinic raffinates as well as naphthas can be upgraded to valuable aromatics.

The effectiveness of reforming catalysts comprising a non-acidic L-zeolite and a platinum-group metal for dehydrocyclization of paraffins is well known in the art. The use of these reforming catalysts to produce aromatics from paraffinic raffinates as well as naphthas has been disclosed by a number of companies active in technology development. Commercialization of this dehydrocyclization technology nevertheless has been slow, probably due at least in part to the intolerance of the such catalysts to contaminants such a sulfur, nitrogen and condensed hydrocarbons. Paraffinic raffinates from aromatics extraction, which are particularly suitable for upgrading with zeolitic catalysts, require special attention relating to specific contaminants as addressed in the present application.

The harmful effects of fused multi-ring aromatic hydrocarbons on gasoline quality and coke formation in reforming are recognized in U.S. Pat. No. 4,664,777 (Hudson et al.). Feedstocks distilling at 177° C. and above are converted catalytically in the presence of hydrogen to lower-boiling hydrocarbons. Elimination of fused multi-ring compounds, especially three-ring compounds, that could affect the noted gasoline endpoint specification of 225° C. is particularly disclosed.

U.S. Pat. No. 4,804,457 (Ngan) teaches multistage adsorption of polynuclear aromatics after each of a series of reforming reactors to reduce coking rate and improve gasoline quality. Ngan addresses the processing of a feed having boiling range of 100° to 400° C., and the polynuclear aromatics removed preferably have three or more aromatic rings; the special contaminant problems associated with the processing of paraffinic raffinates are not addressed.

SUMMARY OF THE INVENTION

It is an object of the present invention to provide a catalytic reforming process with improved catalyst performance. A corollary objective is to improve zeolite catalyst stability in a paraffin aromatization process.

This invention is based on the discovery that removal of trace amounts of indan from a raffinate feed to a low-pressure aromatization unit using an L-zeolite aromatization catalyst improves catalyst stability significantly.

A broad embodiment of the present invention is a process combination in which a paraffinic hydrocarbon feedstock is processed to selectively remove feedstock contaminants which could deactivate an aromatization catalyst and aromatized using a zeolitic catalyst. Indan preferably is removed selectively from the aromatization feedstock using a molecular-sieve adsorbent. An adsorbent comprising a FAU zeolite is especially favored. At least about 80% of the indan in the raffinate is removed, while retaining 95% or more of $C_8$ hydrocarbons in the aromatization feed.

Aromatization preferably is effected using a catalyst containing nonacidic L-zeolite, most preferably potassium-form L-zeolite. The aromatization catalyst contains a platinum-group metal, preferably platinum along with an alkali metal and an inorganic-oxide binder.

These as well as other objects and embodiments will become apparent from the detailed description of the invention.

DESCRIPTION OF THE PREFERRED EMBODIMENTS

Figure 1:
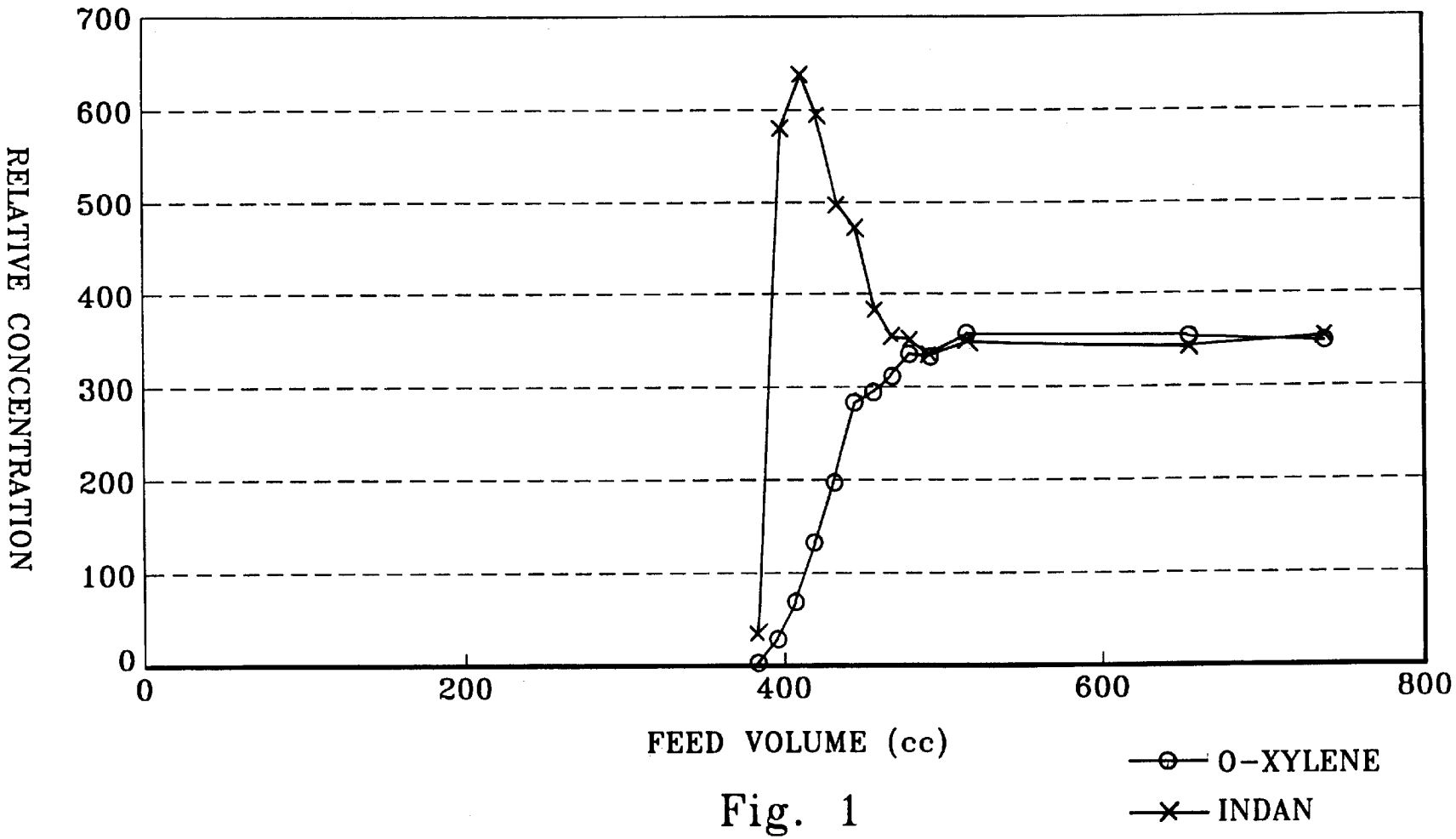
FIG. 1 shows the breakthrough of indan and ortho-xylene through an adsorbent bed of Na—X zeolite as a function of the volume of paraffinic feed processed.

The process of the present invention broadly comprises a process combination for feedstock species control in conjunction with the aromatization of a paraffinic hydrocarbon feedstock which preferably comprises a raffinate from aromatics extraction. Indan preferably is removed selectively from the aromatization feedstock using a molecular-sieve adsorbent, especially a FAU zeolite. Aromatization preferably is effected using a catalyst containing nonacidic L-zeolite, most preferably potassium-form L-zeolite.

The hydrocarbon feedstock to the present process comprises paraffins, naphthenes, smaller amounts of aromatics and often olefins, boiling within the gasoline range. Feedstocks which may be utilized include straight-run naphthas, natural gasoline, synthetic naphthas, thermal gasoline, catalytically cracked gasoline, partially reformed naphthas or raffinates from extraction of aromatics. The distillation range may be that of a full-range naphtha, having an initial boiling point typically from 40°–80° C. and a final boiling point of from about 160°–210° C., or it may represent a narrower range with a lower final boiling point of as low as about 110° or even 85° C. Usually the feedstock includes hexanes, which are effectively converted to benzene according to the present invention, but not substantial amounts (less than about 10 mass-%) of pentanes; thus, the initial boiling point preferably is at least about 60° C. Paraffinic feedstocks, such as naphthas from Middle East crudes or raffinates from aromatics extraction, are advantageously processed since the process effectively dehydrocyclizes paraffins to aromatics. A paraffinic feedstock contains at least 60 mass-%, preferably about 70 mass-% or more, and optimally at least about 90 mass-% paraffins.

The preferred feedstock comprises paraffinic raffinate from aromatics extraction, containing principally low-value $C_6$–$C_8$ paraffins which are difficult to process by conventional reforming but can be converted selectively to valuable BTX (benzene-toluene-xylenes) aromatics according to the present process. Such raffinates have relatively low naphthenes contents, as the naphthenes mostly have been converted in a reforming unit preceding the aromatics extraction, and low contents of aromatics which have been extracted. Small amounts of bicyclic aromatics are present in the feedstock to the present invention, notably indan which if identifiable in the feedstock may be present in a concentration of from about 0.005 to 0.5 mass-%; indan contents of about 0.01 mass-% or more, and especially at least 0.02 mass-%, are particularly suitable for the combination of the present invention.

Raffinate feedstock suitably is derived from a naphtha feedstock by conventional processing as known in the art, comprising catalytic reforming followed by aromatics extraction to recover aromatic hydrocarbons for chemical conversion or other specialty uses. The paraffinic raffinate after extraction of aromatics is the preferred feedstock to the present process. The naphtha feedstock to the conventional catalytic reforming unit usually contains a high concentration of hydrocarbons in the $C_6$–$C_8$ range, yielding benzene, toluene, xylenes and ethylbenzene which enjoy the highest demand among aromatic intermediates. The naphtha feedstock usually has been processed by hydrotreating prior to catalytic reforming to protect the reforming catalyst from sulfur, nitrogen and oxygen contamination. The raffinate, therefore, usually has low concentrations of such contaminants with the content each of sulfur, nitrogen and oxygen typically each in the range of 10 mass ppb (parts per billion) to 5 ppm (parts per million). The hydrocarbons are principally in the $C_6$–$C_8$ range, with a relatively high concentration of hexanes due to hydrocracking of heavier paraffins. Small amounts of heavier materials such as indan remain in the raffinate due to extraction inefficiencies.

The separation zone of the present invention preferably comprises adsorptive separation. Adsorptive separation selectively separates indan, other bicyclics, and compounds containing sulfur, oxygen and nitrogen from compounds such as single-ring aromatics which are desirable feeds for further processing or recovery. Indan may be separated from a paraffinic raffinate by fractional distillation as known in the art, but separation by boiling point tends to provide less precision in separation of species than adsorption.

The present invention suitably can be practiced in fixed or moving adsorbent bed systems, in which adsorption of indan from the paraffinic feedstock is effected followed by displacement of an indan concentrate using a desorbent fluid. The preferred system for this separation is a countercurrent simulated moving bed system, such as described in Broughton U.S. Pat. No. 2,985,589, incorporated herein by reference. Cyclic advancement of the input and output streams can be accomplished by a manifolding system, e.g., by rotary disc valves as taught in U.S. Pat. Nos. 3,040,777 and 3,422,848. Equipment utilizing these principles are familiar, in sizes ranging from pilot plant scale (deRosset U.S. Pat. No. 3,706,812) to commercial scale.

Although either liquid and vapor phase operations can be used in adsorptive separation processes, liquid-phase operation is preferred for this process because of the lower temperature requirements and because of the higher yields of extract product than can be obtained with liquid-phase operation over those obtained with vapor-phase operation. Adsorption conditions in the separation zone include a temperature range of from about 20° to about 250° C. and a pressure sufficient to maintain liquid phase, ranging from about 100 kPa to about 3 MPa. Desorption conditions will include the same range of temperatures and pressures as used for adsorption conditions. Suitable desorbents include water and single-ring aromatic compounds, such as benzene, toluene, xylenes, and ethylbenzene, with water being the preferred desorbent. Separation means such as fractionators or evaporators may be appropriate to remove at least a portion of the desorbent material to upgrade the extract and/or raffinate.

Adsorbents to be used in the process of this invention comprise specific molecular sieves, preferably crystalline zeolitic aluminosilicates. The crystalline aluminosilicates, or zeolites have known cage structures in which the alumina and silica tetrahedra are intimately connected in an open three-dimensional network to form cage-like structures with window-like pores. The tetrahedra are cross-linked by the sharing of oxygen atoms with spaces between the tetrahedra occupied by water molecules prior to partial or total dehydration of this zeolite. The dehydration of the zeolite results in crystals interlaced with cells having molecular dimensions and thus, the crystalline aluminosilicates are often referred to as "molecular sieves" when the separation which they effect is dependent essentially upon differences between the sizes of the feed molecules as, for instance, when smaller normal paraffin molecules are separated from larger isoparaffin molecules by using a particular molecular sieve. In the context of this invention, the designation "molecular sieve" is a general term since the separation of bicyclics from other aromatic hydrocarbons having similar boiling points is apparently dependent on differences in electrochemical attraction of the different isomers and the adsorbent rather than on pure physical size differences in the isomer molecules.

The molecular-sieve adsorbent used in the present process preferably is selected from one or more of FAU, FER, MEL, MFI and MTT (IUPAC Commission on Zeolite Nomenclature) and the non-zeolitic molecular sieves of U.S. Pat. Nos. 4,310,440; 4,440,871; and 4,554,143. Isotypic crystalline zeolitic aluminosilicates of the FAU structure, especially type X zeolite, are highly preferred. These zeolites are described and defined in U.S. Pat. No. 2,882,244. In hydrated or partially hydrated form the type X crystalline aluminosilicates encompass those zeolites represented, in terms of moles of metal oxides, by the following formula:

$$(0.9\pm0.2)M_{2/n}O:Al_2O_3:(2.5\pm0.5)SiO_2:yH_2O$$

where "M" is a cation which balances the electrovalence of the tetrahedra and is generally referred to as an exchangeable cationic site, "n" represents the valence of the cation and "y" is a value up to about 9 and represents the degree of hydration of the crystalline structure.

The type X zeolites are initially prepared predominantly in the sodium form. The sodium cation can be replaced or exchanged with other specific cations, dependent on the type of the zeolite to modify characteristics of the zeolite. Such ion exchange methods, well known to those having ordinary skill in the field of crystalline aluminosilicates, generally are performed by contacting the zeolite or an adsorbent material containing the zeolite with an aqueous solution of the soluble salt, e.g., the chloride of the cation or cations desired to be placed upon the zeolite. After the exchange takes place, the sieves are removed from the aqueous solution washed, then dried to a desired water content. The water content of the adsorbent as measured by loss on ignition (LOI) at 900° C. may be from about 0.5 to about 10 wt. %, but to prevent capacity loss, it is preferred that the water content is below about 4 wt. %. The sodium form of type X zeolite, or Na—X, is preferred for use in the separation zone of the present invention, with suitable alternatives being one or more of Ba—X (barium X-type), Li—X (lithium X-type) and Ca—Y (calcium Y-type).

Typically, adsorbents used in separative processes contain the crystalline material dispersed in an amorphous inorganic matrix or binder, having channels and cavities therein which enable liquid access to the crystalline material. Amorphous material such as silica, or silica-alumina mixtures or compounds, such as clays, are typical of such inorganic matrix materials. The binder aids in forming or agglomerating the crystalline particles of the zeolite which otherwise would comprise a fine powder. The adsorbent may thus be in the form of particles such as typical of such inorganic matrix materials. The binder aids in forming or agglomerating the crystalline particles of the zeolite which otherwise would comprise a fine powder. The adsorbent may thus in the form of particles such as extrudates, aggregates, tablets, macrospheres or granules having a desired particle size range, from about 16 to about 40 mesh (Standard U.S. Mesh, corresponding to 1.9 mm to 250 $\mu$).

The aromatization zone comprises one or more reactors containing the aromatization catalyst. Since a major reaction occurring in the aromatization zone is the dehydrocyclization of paraffins to aromatics along with the usual dehydrogenation of naphthenes, the resulting endothermic heat of reaction may cool the reactants below the temperature at which reforming takes place before sufficient dehydrocyclization has occurred. This zone therefore preferably comprises two or more reactors with interheating between reactors to raise the temperature and maintain dehydrocyclization conditions to achieve a higher concentration of aromatics in the aromatics-enriched stream than would be obtained in a single reactor.

Aromatization of the indan-depleted paraffinic intermediate in an aromatization zone produces an aromatics concentrate, with the aromatics content of the $C_5$+ portion increased by at least 5 mass % relative to the aromatics content of the intermediate. The composition of the aromatics depends principally on the feedstock composition and operating conditions. Benzene, toluene and $C_8$ aromatics are the primary aromatics produced from an intermediate derived from the preferred raffinate feedstock. Since the raffinate contains relatively low concentrations of naphthenes, the principal reaction yielding aromatics from the raffinate feedstock is dehydrocyclization of paraffins.

Dehydrocyclization conditions used in the aromatization step of the present invention include a pressure of from about 100 kPa to 6 MPa (absolute), with the preferred range being from about 100 kPa to 2 MPa and a pressure of below 1 MPa being especially preferred. Free hydrogen preferably is supplied to the process in an amount sufficient to correspond to a ratio of from about 0.1 to 10 moles of hydrogen per mole of hydrocarbon feedstock. By "free hydrogen" is meant molecular $H_2$, not combined in hydrocarbons or other compounds. Preferably, the reaction is carried out in the absence of added halogen. The volume of catalyst corresponds to a liquid hourly space velocity of from about 0.1 to 40 $hr^{-1}$. The operating temperature generally is in the range of 260° to 560° C. Temperature selection is influenced by product objectives, with higher temperatures effecting higher conversion to aromatics and light hydrocarbons. The temperature generally is slowly increased during each period of operation to compensate for inevitable catalyst deactivation.

The aromatization catalyst comprises a non-acidic large-pore molecular sieve. Suitable molecular sieves generally have a maximum free channel diameter or "pore size" of 6 Å or larger, and preferably have a moderately large pore size of about 7 to 8 Å. Such molecular sieves include those characterized as AFI, BEA, FAU or LTL structure type by the IUPAC Commission on Zeolite Nomenclature, with a zeolite of the LTL structure being preferred. It is essential that the preferred L-zeolite be non-acidic, as acidity in the zeolite lowers the selectivity to aromatics of the finished catalyst. In order to be "non-acidic," the zeolite has substantially all of its cationic exchange sites occupied by nonhydrogen species. Preferably the cations occupying the exchangeable cation sites will comprise one or more of the alkali metals, although other cationic species may be present. An especially preferred nonacidic L-zeolite is potassium-form L-zeolite.

The L-zeolite is composited with a binder in order to provide a convenient form for use in the catalyst particles of the present invention. The art teaches that any refractory inorganic oxide binder is suitable. One or more of silica, alumina or magnesia are preferred binder materials of the present invention. Amorphous silica is especially preferred, and excellent results are obtained when using a synthetic white silica powder precipitated as ultra-fine spherical particles from a water solution. The silica binder preferably is nonacidic, contains less than 0.3 mass % sulfate salts, and has a BET surface area of from about 120 to 160 $m^2/g$.

The L-zeolite and binder may be composited to form particle shapes known to those skilled in the art such as spheres, extrudates, rods, pills, pellets, tablets or granules. Spherical particles may be formed directly by the oil-drop method as disclosed hereinbelow or from extrudates by rolling extrudate particles on a spinning disk. In one method of forming extrudates, potassium-form L-zeolite and amorphous silica are commingled as a uniform powder blend prior to introduction of a peptizing agent. An aqueous solution comprising sodium hydroxide is added to form an extrudable dough. The dough preferably will have a moisture content of from 30 to 50 mass % in order to form extrudates having acceptable integrity to withstand direct calcination. The resulting dough is extruded through a suitably shaped and sized die to form extrudate particles, which are dried and calcined generally by known methods. Preferably, extrudates are subjected directly to calcination without an intermediate drying step in order to encapsulate potassium ions and preserve basicity. The calcination of the extrudates is effected in an oxygen-containing atmosphere at a temperature of from about 260° to 650° C. for a period of about 0.5 to 2 hours.

An alternative alumina form of the present catalyst support is the sphere. Alumina spheres may be continuously manufactured by the well known oil-drop method which comprises: forming an alumina hydrosol by any of the techniques taught in the art and preferably by reacting aluminum metal with hydrochloric acid; combining the resulting hydrosol with a suitable gelling agent; and dropping the resultant mixture into an oil bath maintained at elevated temperatures. The droplets of the mixture remain in the oil bath until they set and form hydrogel spheres. The spheres are then continuously withdrawn from the oil bath and typically subjected to specific aging and drying treatments in oil and an ammoniacal solution to further improve their physical characteristics. The resulting aged and gelled particles are then washed and dried at a relatively low temperature of about 150° to about 205° C. and subjected to a calcination procedure at a temperature of about 450° to about 700° C. for a period of about 1 to about 20 hours. This treatment effects conversion of the alumina hydrogel to the corresponding crystalline gamma-alumina. U.S. Pat. No. 2,620,314 provides for additional details and is incorporated herein by reference thereto.

A reforming-catalyst support may incorporate other porous, adsorptive, high-surface-area materials. Within the scope of the present invention are refractory supports containing one or more of: (1) refractory inorganic oxides such as alumina, silica, titania, magnesia, zirconia, chromia, thoria, boria or mixtures thereof, (2) synthetically prepared or naturally occurring clays and silicates, which may be acid-treated; (3) crystalline zeolitic aluminosilicates, either naturally occurring or synthetically prepared such as FAU, MEL, MFI, MOR, MTW (IUPAC Commission on Zeolite Nomenclature), in hydrogen form or in a form which has been exchanged with metal cations; (4) spinels such as $MgAl_2O_4$, $FeAl_2O_4$, $ZnAl_2O_4$; and (5) combinations of materials from one or more of these groups.

An alkali-metal component is an essential constituent of the aromatization catalyst. One or more of the alkali metals, including lithium, sodium, potassium, rubidium, cesium and mixtures thereof, may be used, with potassium being preferred. The alkali metal optimally will occupy essentially all of the cationic exchangeable sites of the non-acidic L-zeolite. Surface-deposited alkali metal also may be present as described in U.S. Pat. No. 4,619,906, incorporated herein in by reference thereto.

A catalytically effective amount of a platinum-group metal component is an essential feature of the aromatization catalyst, with a platinum component being preferred. The platinum-group metal component may be incorporated in the catalyst in any suitable manner such as but not limited to coprecipitation, ion exchange or impregnation with a soluble, decomposable compound of the metal. The platinum-group metal may exist within the catalyst as a compound such as the oxide, sulfide, halide, or oxyhalide, in chemical combination with one or more other ingredients of the catalytic composite, or as an elemental metal. Best results are obtained when substantially all of the metal exists in the catalytic composite in a reduced state. The preferred platinum component generally comprises from about 0.01 to 5 mass % of the catalytic composite, preferably 0.05 to 2 mass %, calculated on an elemental basis.

It is within the scope of the present invention that the catalyst may contain other metal components known to modify the effect of the preferred platinum component. Such metal modifiers may include Group IVA(IUPAC 14) metals [See Cotton and Wilkinson, *Advanced Inorganic Chemistry,* John Wiley & Sons (Fifth Edition, 1988) for IUPAC notation], other Group VIII(IUPAC 8–10) metals, rhenium, indium, gallium, zinc, uranium, dysprosium, thallium and mixtures thereof. Catalytically effective amounts of such metal modifiers may be incorporated into the catalyst by any means known in the art.

The final aromatization catalyst generally will be dried at a temperature of from about 100° to 320° C. for about 0.5 to 24 hours, followed by oxidation at a temperature of about 300° to 550° C. (preferably about 350° C.) in an air atmosphere for 0.5 to 10 hours. Preferably the oxidized catalyst is subjected to a substantially water-free reduction step at a temperature of about 300° to 550° C. (preferably about 350° C.) for 0.5 to 10 hours or more. The duration of the reduction step should be only as long as necessary to reduce the platinum, in order to avoid pre-deactivation of the catalyst, and may be performed in-situ as part of the plant startup if a dry atmosphere is maintained. Further details of the preparation and activation of embodiments of the aromatization catalyst are disclosed, e.g., in U.S. Pat. No. 4,619,906 (Lambert et al) and U.S. Pat. No. 4,822,762 (Ellig et al.), which are incorporated into this specification by reference thereto.

The feed to the aromatization zone may contact the respective catalyst in each of the respective reactors in either upflow, downflow, or radial-flow mode. Since the present reforming process operates at relatively low pressure, the low pressure drop in a radial-flow reactor favors the radial-flow mode. The aromatization catalyst is contained in a fixed-bed reactor or in a moving-bed reactor whereby catalyst may be continuously withdrawn and added. These alternatives are associated with catalyst-regeneration options known to those of ordinary skill in the art, such as: (1) a semiregenerative unit containing fixed-bed reactors maintains operating severity by increasing temperature, eventually shutting the unit down for catalyst regeneration and reactivation; (2) a swing-reactor unit, in which individual fixed-bed reactors are serially isolated by manifolding arrangements as the catalyst become deactivated and the catalyst in the isolated reactor is regenerated and reactivated while the other reactors remain on-stream; (3) continuous regeneration of catalyst withdrawn from a moving-bed reactor, with reactivation and substitution of the reactivated catalyst, permitting higher operating severity by maintaining high catalyst activity through regeneration cycles of a few days; or: (4) a hybrid system with semiregenerative and continuous-regeneration provisions in the same unit. The preferred embodiment of the present invention is a fixed-bed reactor in a semiregenerative aromatization zone.

Using techniques and equipment known in the art, a reformed effluent from the reforming zone usually is passed through a cooling zone to a separation zone. In the separation zone, typically maintained at about 0° to 65° C., a hydrogen-rich gas is separated from a liquid phase. Most of the resultant hydrogen-rich stream optimally is recycled through suitable compressing means back to the aromatization zone, with a portion of the hydrogen being available as a net product for use in other sections of a petroleum refinery or chemical plant. The liquid phase from the separation zone is normally withdrawn and processed in a fractionating system in order to adjust the concentration of light hydrocarbons and to produce an aromatics concentrate. The concentrate may be further processed, e.g., by extraction, to recover purified aromatics such as benzene, toluene, xylenes and ethylbenzene.

EXAMPLES

The following examples are presented to demonstrate the present invention and to illustrate certain specific embodiments thereof. These examples should not be construed to limit the scope of the invention as set forth in the claims. There are many possible other variations, as those of ordinary skill in the art will recognize, which are within the spirit of the invention.

Three parameters are especially useful in evaluating reforming process and catalyst performance, particularly in evaluating catalysts for dehydrocyclization of paraffins. "Activity" is a measure of the catalyst's ability to convert reactants at a specified set of reaction conditions. "Selectivity" is an indication of the catalyst's ability to produce a high yield of the desired product. "Stability" is a measure of the catalyst's ability to maintain its activity and selectivity over time.

Example I

A pilot-plant test was performed to ascertain the effectiveness of a zeolitic molecular sieve in selective adsorption of heavy aromatics from a paraffinic stock.

A feed was blended in order to have a standard test sample for comparative determinations. The feed had a normal-hexane base and contained 1 volume-% each of indan, naphthalene and ortho-xylene.

The adsorbent was the Na—X version of FAU, and 70 cc of adsorbent was loaded in the pilot plant. The feed was processed at 40° C. at 2 liquid hourly space velocity. Indan and ortho-xylene breakthrough occurred after about 400 cc of feed had been processed, as shown in FIG. 1. Naphthalene did not break through during the test period.

Example II

A pilot-plant test was performed to ascertain the effectiveness of a zeolitic molecular sieve in selective adsorption of heavy aromatics from a potential reforming feedstock.

The test was carried out using a raffinate from reforming and naphtha extraction comprising principally $C_6$–$C_8$ paraffins. The composition was as follows in mass-%:

Pentanes 6.45
Cyclopentane 0.50
Hexanes 37.30
$C_6$ naphthenes 1.95
Benzene 0.20
Heptanes 33.00
$C_7$ naphthenes 1.05
Toluene 0.15
Octanes 14.35
$C_8$ naphthenes 0.45
$C_8$ aromatics 1.25
$C_9$+ paraffins 1.15
$C_9$+ naphthenes 0.10
$C_9$+ aromatics 2.10

The feedstock contained about 0.015 mass-% indan; sulfur content after hydrotreating was about 0.01 mass ppm and the nitrogen content was 1.2–1.3 ppm.

Figure 2:
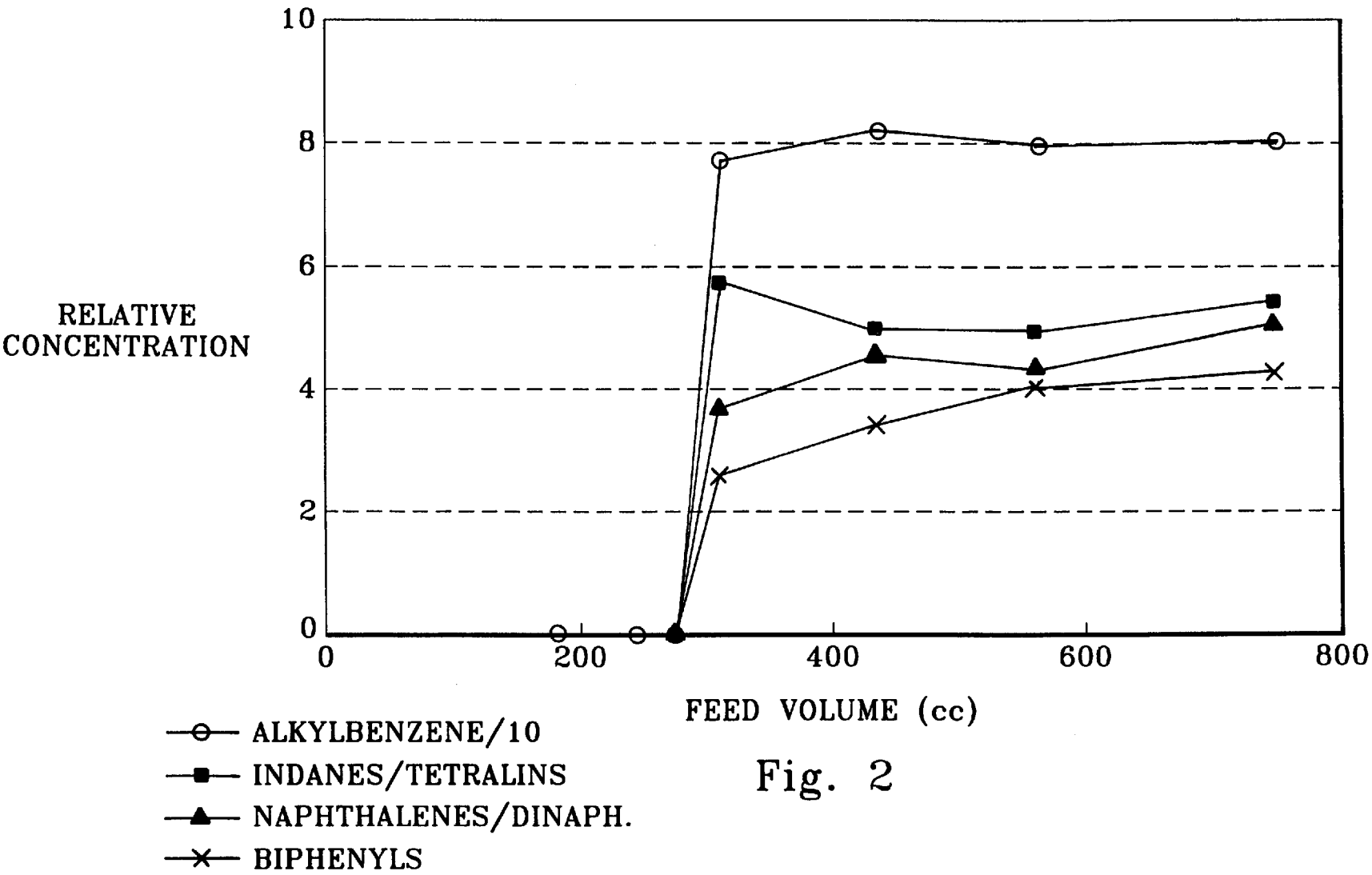
FIG. 2 shows the breakthrough of indan and other components through an adsorbent bed of Na—X zeolite as a function of the volume of raffinate processed.

The adsorbent was the Na—X version of FAU, and 70 cc of adsorbent was loaded in the pilot plant. The feed was processed at 40° C. at 2 liquid hourly space velocity. Breakthrough of indan, naphthalenes, biphenyls and ortho-xylene occurred just before about 300 cc of feed had been processed, as shown in FIG. 2. There was no breakthrough of sulfur or nitrogen during the test period.

Example III

A pilot-plant test was performed to ascertain the effect of removing indan from a reforming feedstock on catalyst stability in an aromatization process. The feedstock was a fraction of the $C_6$–$C_8$ raffinate described in Example II which had a high concentration of normal paraffins. The composition was as follows in mass-%:

Pentanes 6.80
Cyclopentane 0.30
Hexanes 39.10
$C_6$ naphthenes 1.20
Benzene 0.20
Heptanes 31.60
$C_7$ naphthenes 0.70
Toluene 0.20
Octanes 13.80
$C_8$ naphthenes 0.30
$C_8$ aromatics 1.40
$C_9$+ paraffins 1.10
$C_9$+ naphthenes 0.20
$C_9$+ aromatics 3.00

The feedstock contained about 0.022 mass-% indan, less than 14 ppb sulfur, and about 1.2 ppm nitrogen, and is referenced below as "Feed A."

In order to evaluate the effect of removing indan from the feed, a portion of the above feedstock was fractionally distilled to remove indan to non-detectable levels; the total content of $C_9$+ hydrocarbons was reduced to about 0.40 mass-%. The thus-generated indan-depleted paraffinic intermediate is referenced as "Feed B."

Example IV

Feed A and Feed B as described in Example III were processed in sequence by aromatization, using a catalyst comprising 0.82 mass-% platinum on silica-bound L-zeolite. Processing conditions were: pressure of about 800 kPa, 1.3 liquid hourly space velocity and 3.0 molar hydrogen to hydrocarbon ratio. Temperature during the pilot-plant run was adjusted to maintain about 58 mass-% conversion of the feed.

Figure 3:
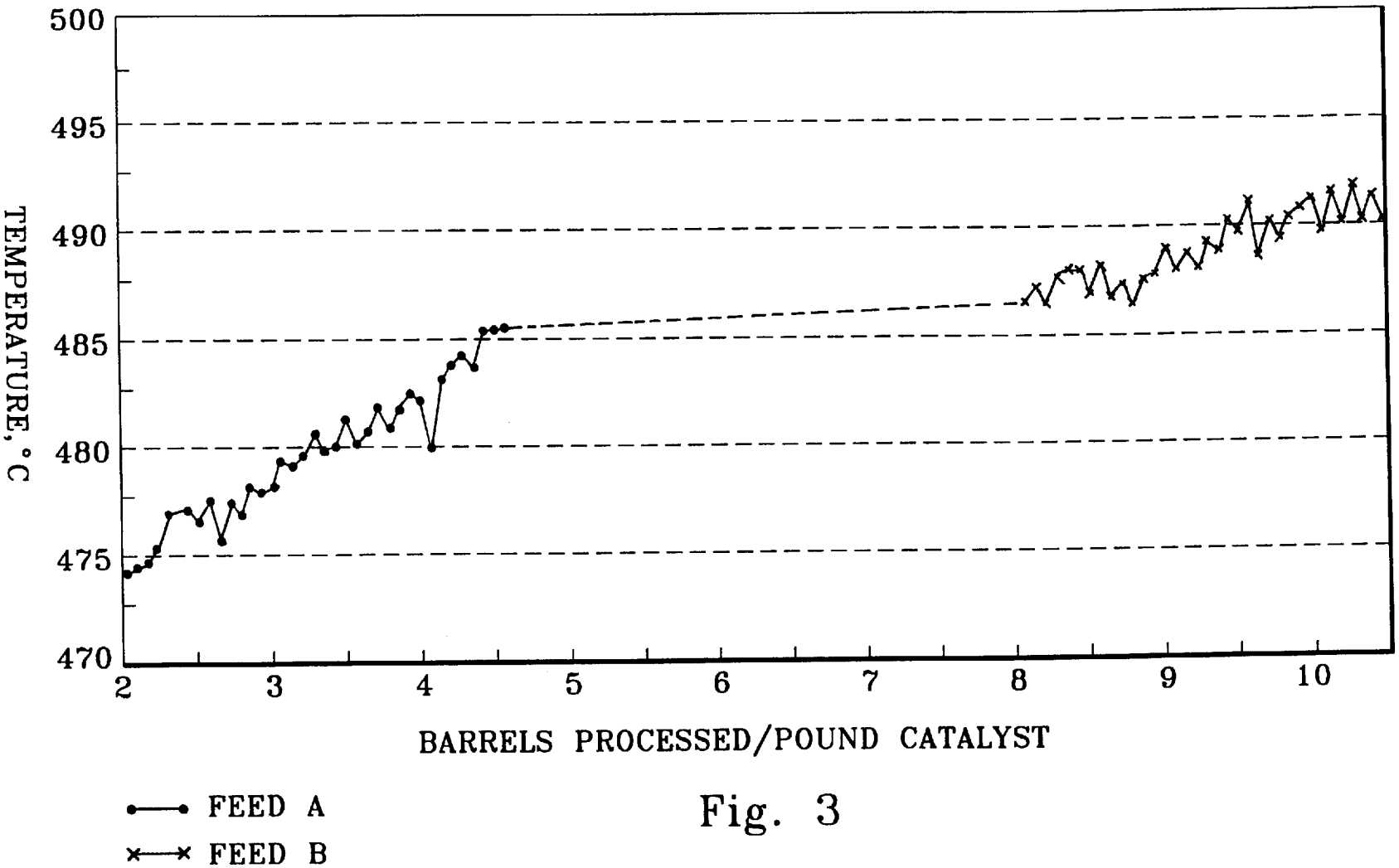
FIG. 3 shows yields and catalyst stability for the aromatization of a raffinate with and without removal of indan before the aromatization step.

The results of the pilot-plant run are shown in FIG. 3. Feed A was processed, after an initial run-in period, from a catalyst life of about 2 to 4½ barrels per pound. An unrelated feedstock was processed up to 8 barrels per pound, at which time Feed B was processed from about 8 to 10½ barrels per pound.

FIG. 3 shows more rapid deactivation of the catalyst, as indicated by the temperature requirement to maintain 58 mass-% conversion, when processing Feed A than when processing Feed B. The measured deactivation rates were 0.60° C. per day when processing Feed A and 0.25° C. per day when processing Feed B.

Product indan contents were 0.045 mass-% when processing Feed A and 0.008 mass-% when processing Feed B.

We claim:

1. A process for the aromatization of paraffins contained in a paraffinic raffinate feedstock which comprises the steps of:

(a) processing the raffinate in an adsorption-separation zone using a crystalline zeolitic aluminosilicate which adsorbs indan at adsorption conditions to obtain a indan-depleted paraffinic intermediate containing single-ring aromatics and a indan concentrate; and, (b) converting the paraffinic intermediate in an aromatization zone at dehydrocyclization conditions with a molecular-sieve aromatization catalyst, comprising a non-acidic large-pore molecular sieve and a platinum-group metal component, to obtain an aromatics concentrate.

2. The process of claim 1 wherein the concentration of indan in the raffinate is from about 0.005 to 0.5 mass-%.

3. The process of claim 1 wherein the indan concentrate contains at least 80% of the indan in the feedstock and the paraffinic intermediate contains at least 95% of $C_8$ hydrocarbons contained in the feedstock.

4. The process of claim 1 wherein the non-acidic large-pore molecular sieve comprises a non-acidic L-zeolite.

5. The process of claim 4 wherein the non-acidic L-zeolite comprises potassium-form L-zeolite.

6. The process of claim 1 wherein the platinum-group metal component comprises platinum in an amount of from about 0.05 to 2 mass % of the catalyst on an elemental basis.

7. The process of claim 1 wherein the aromatization catalyst further comprises a refractory inorganic oxide.

8. The process of claim 1 wherein the aromatization catalyst further comprises an alkali-metal component.

9. The process of claim 8 wherein the alkali-metal component comprises a potassium component.

10. The process of claim 1 wherein the dehydrocyclization conditions of step (b) comprise a pressure of from about 100 kPa to 6 MPa (absolute), a ratio of from about 0.1 to 10 moles of hydrogen per mole of hydrocarbon feedstock, a liquid hourly space velocity of from about 0.1 to 40 $hr^{-1}$, and an operating temperature of from about 260° to 560° C.

11. The process of claim 1 wherein the crystalline zeolitic aluminosilicate is selected from the isotypic group consisting of FAU molecular sieves.

12. The process of claim 1 wherein the FAU molecular sieves is selected from the one or more of the group consisting of Na—X, Ba—X, Li—X and Ca—Y.

* * * * *